US010046909B2

(12) United States Patent
Tullo

(10) Patent No.: US 10,046,909 B2
(45) Date of Patent: Aug. 14, 2018

(54) DUMPSTER PADS

(71) Applicant: Dumpster & Trailer Pads International, LLC, Derby, CT (US)

(72) Inventor: Michael Tullo, Derby, CT (US)

(73) Assignee: Dumpster & Trailer Pads International, LLC, Derby, CT (US)

( * ) Notice: Subject to any disclaimer, the term of this patent is extended or adjusted under 35 U.S.C. 154(b) by 188 days.

(21) Appl. No.: 15/054,890

(22) Filed: Feb. 26, 2016

(65) Prior Publication Data

US 2017/0247185 A1 Aug. 31, 2017

(51) Int. Cl.
*B65F 1/14* (2006.01)

(52) U.S. Cl.
CPC ..... *B65F 1/141* (2013.01)

(58) Field of Classification Search
CPC ..... A47B 91/12; A47B 91/06; A47B 91/00
See application file for complete search history.

(56) References Cited

U.S. PATENT DOCUMENTS 4,679,818 A * 7/1987 Kakavas ..... A47F 3/14 108/90
4,915,335 A * 4/1990 Miles ..... A47C 7/002 248/188.8
5,210,903 A * 5/1993 Horning ..... B60B 33/00 16/18 R
9,586,562 B1 * 3/2017 Noonan ..... B60T 3/00
2012/0242051 A1 9/2012 Lacasse

FOREIGN PATENT DOCUMENTS

DE 202012011067 U1 12/2012

OTHER PUBLICATIONS

International Search Report and Written Opinion dated Apr. 11, 2017 (PCT/US2017/019625).

* cited by examiner

*Primary Examiner* — Amy Jo Sterling
(74) *Attorney, Agent, or Firm* — Alix, Yale & Ristas, LLP

(57) ABSTRACT

The disclosed pads are engaged with dumpster supports to spread the weight of the dumpster over a large surface area and provide a relatively soft ground contact interface to prevent damage to paved surfaces on which the dumpster may be placed. The pads define a cavity complementary to the dumpster support and may be affixed to the support by straps or fasteners. The pads can be constructed of flexible material and distorted to open the cavity to receive the support, then relaxed to grip the support. The pads have a ground contact surface greater than a contact surface of the dumpster support and may include grooves in the ground contact surface.

11 Claims, 10 Drawing Sheets

DUMPSTER PADS

TECHNICAL FIELD

The present invention generally relates to dumpsters employed for disposal of waste. More particularly, the present invention is directed to apparatus and methods for preventing damage to paved surfaces on which dumpsters are placed.

BACKGROUND OF THE INVENTION

A so called "roll off" dumpster is usually an open top rectangular container equipped with wheels to facilitate placement and removal of the dumpster. Construction debris may originate from a building site where something is being built, renovated, or demolished. Roll-off dumpsters are used for moving material away from a work site. The material in the roll off may be taken to a landfill, recycled, or disposed/recovered in some other way.

The debris container of a roll off dumpster is typically an open top rectangular reinforced steel box designed to be transported by special roll-off trucks. Some roll-off dumpsters have a swinging door on one longitudinal end to facilitate loading and disposal of waste. Roll-off containers typically have a rectangular footprint typically determined by the size of typical trucks. Roll-off container sizes are determined by the amount of volume of debris they contain. Typical container sizes in the United States are 10, 15, 20, 30, and 40 cubic yards. A typical 40 cubic yard container may, for example, be 6' 5" high by 21'6" long and 8' 6" wide and may have a load limitation imposed by a rental entity of six tons. Even larger 100 yard containers that measure 8' wide, 48' long and 136" high are also available. Weight limits are necessary to ensure compliance with road-use and safety laws and regulations as well as the integrity of the container and truck. Large roll off dumpsters typically have four metal roller-shaped wheels disposed at the corners of the rectangular container. Smaller roll off dumpsters have two wheels on one end and a pair of runners at the opposite end of the container. Roll-off dumpsters are placed by roll-off trucks equipped with a hydraulically operated bed and rails arranged to align with the wheels. The bed is raised and a cable is used to slowly lower the container until the rear-most pair of wheels contacts the ground. After the waste container is loaded with debris, the roll-off truck pulls the filled container onto the roll-off truck by using a cable and winch system. Some roll-off trucks may employ a hook-lift system.

Front load dumpsters are also relevant to the disclosure. Front load dumpsters are commonly used for waste handling at businesses, condominiums and apartment complexes. Front load dumpsters typically include sliding doors for waste disposal and pivoting covers to enclose the top of the container. Front load dumpsters include channels open toward the front of the dumpster that are engaged by two large elongated forks extending generally forward of the cab of the truck. Front load dumpsters are emptied by inserting the forks into the channels and hydraulically raising the dumpster to tip the contents into the waste bin of the truck, then lowered again. Front load dumpsters rest on box shaped steel tubing extending across the bottom of the debris container.

One problem often encountered with roll-off dumpsters as well as front load dumpsters is liability for damaging the surface on which the container is placed. Most dumpsters are placed by necessity on paved surfaces such as asphalt or concrete. Damage to the surface on which the container is placed, such as a concrete or asphalt paved surface, may occur during placement, removal or even when the container merely rests on the surface for an extended period of time. It will be understood that such containers are often very heavy when empty and extremely heavy when loaded. The damage to asphalt surfaces is most extreme in warm weather occasions which soften the asphalt.

The use of cylindrical wheels to support such containers on a planar support surface result in a line contact between the cylindrical wheel and the support surface. Cylindrical wheels and narrow steel rails concentrate the force of the dumpsters on the support surface in a small surface area, which can damage the surface. Any backward or forward movement of the truck during placement increases the surface area that is damaged. It is also possible for wheel-supported dumpsters to roll on an inclined surface, which can be very dangerous to persons and traffic in the vicinity. The box tubes on the bottom of front load dumpsters tend to rust due to ground contact, leaving rust stains on the support surface. Rusted out support tubes must eventually be replaced.

It is common for dumpster companies and property owners to use wood sheets or blocks to support a dumpster and prevent damage to the support surface. Trucks used to deliver, retrieve and empty dumpsters are typically operated by a single driver/operator, so one problem with this approach is that the operator of the truck used to place the container cannot see the precise location of the plywood at the time of container placement. This can result in the dumpster missing the wood, and may necessitate the operator getting in and out of the vehicle cab several times when dropping off a dumpster. Further, the blocks or wood sheets must be delivered with the dumpster, and the dumpster trucks do not typically have room to safely store and transport such materials. It is not permitted to have such heavy objects loose in the cab of the truck.

There is a need in the art for apparatus and methods to reduce the potential damage to paved support surfaces that can result from the use of dumpsters.

SUMMARY OF THE INVENTION

The disclosure relates to pads configured to engage the support wheels, rails or box tube of various dumpster configurations. The pads are configured to securely engage the support, whether it is a wheel, a rail, or a box tube. The pads raise the dumpster off the support surface, permitting normal flow of surface water beneath and around the dumpster, while reducing moisture exposure and rust on the dumpster itself. The pads may be constructed of relatively soft, tough material such as recycled rubber or plastic that will not permanently mark the support surface. The pads may be constructed using any known methods such as molding, extruding, lamination from sheet materials, etc. The pads are configured to expand the surface area upon which the dumpster is supported, reducing local surface pressure and the likelihood of surface damage. The pads may be configured to permanently mount to the dumpster using hardware, or may be installed only when the dumpster is deployed on a support surface.

The configuration of the disclosed dumpster pads will vary depending upon the type of dumpster and the support structure to which the pads will be secured. In embodiments for use with a wheel-supported dumpster, the pad will be configured to fit over the wheel and provide an enlarged rectangular support surface in place of the line of support provided by the wheel. Dumpster wheels vary in size and the disclosed pads are sized to fit the most common wheel diameters and widths. The pad will include a cylindrical inside surface configured to receive wheel and mate with the outside surface of the wheel. The pad may extend around more than one half the circumference of the wheel, resulting in a configuration that may grip the wheel. This pad configuration also serves as a "chock" for the relevant wheel, preventing rolling of the wheel along the support surface.

In some embodiments the pad has an elongated channel configured to receive a rib projecting from the associated dumpster. Pads may also be configured to fill the end of box tubes and extend beneath the box tubes to raise the dumpster off the ground. In some embodiments, the pad may include a plurality of grooves in the ground contact surface of the pad. The grooves may be arranged transverse to the length of the pad to promote water flow past and around the pad. Grooves may extend in more than one direction to promote frictional engagement with the support surface.

The pads are generally configured to expand the surface area upon which the dumpster rests. The pads have a length and width suitable for this purpose and may increase in length and width as the pad progresses way from the dumpster toward the ground.

Pads configured for use with box tube support members may include a channel on an upper surface, where the channel is configured to receive the lower portion of the box tube. The channel may be defined between first and second walls disposed in space relationship and projecting upwardly from a base of the pad. Such embodiments may further include a generally rectangular plug dimensioned for snug engagement with the open end of the box tube. The plug projects into the channel from one end, meaning that there are pads configured to close each end of the box channel. The pad base and channel extend longitudinally beneath the box tube, providing an expanded support surface area and raising the box tube off the ground. The pad may be secured to the box tube using hardware passing through openings in the pad.

Embodiments of a pad in accordance with aspects of the present disclosure may be manufactured from suitably durable materials. Some elasticity is helpful to installation and removal of the disclosed pads. For example, such pads may be manufactured of rubber, recycled rubber, rubber reinforced by fibers or the like, and plastic, including recycled plastic. The pads may be reinforced near apertures used to secure the pad to the dumpster. The pads may include interior structure in addition to the flexible, durable primary pad material. The pads may have a substantially constant cross sectional configuration and may be manufactured by extrusion of appropriate material through a die, then cut to lengths suitable for a particular application.

Accordingly, it is an object of the present disclosure to provide a pad for the roller shaped wheels and/or the runners disposed on the bottom of such containers that will survive the loads inherent in such large and heavy containers.

It is another object of the present disclosure to provide pads that facilitate attachment of the pad to the wheels, runners and box tubes of a respective container when the container is elevated above the ground.

It is yet another object of the present disclosure to provide an attachment means for the pads that will securely attach each pad to a respective wheel, or runner, or box tube. Attachment of the pad would be very difficult after the dumpster is set in place and setting the dumpster in place without the pad is likely to damage the paved surface under the container.

It is a still further object of the present disclosure to provide a protective pad for the surface on which a dumpster is placed that can be securely attached to the dumpster during placement.

It is still another object of the present disclosure to provide a protective pad that will expand the surface area upon which a dumpster is supported, reducing the local surface pressure and reducing the likelihood of damage to a paved surface beneath the dumpster.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The foregoing and other objects, features and advantages of the disclosed dumpster pads will be apparent from the following more particular description of illustrative embodiments, as shown in the accompanying drawings in which like reference characters refer to the same parts throughout the different views. The drawings are not necessarily to scale, emphasis instead being placed upon illustrating the general structure and function of the disclosed dumpster pads. Those skilled in the art will understand that the devices and methods specifically described herein and illustrated in the accompanying drawings are non-limiting exemplary embodiments. The features illustrated or described in connection with one exemplary embodiment can be combined with the features of other embodiments. Such modifications and variations are intended to be included within the scope of the appended claims.

The disclosed dumpster pads may best be understood by reference to the following description taken in connection with the accompanying drawings, in which.

DETAILED DESCRIPTION

The present invention has application to small and large roll off dumpsters as well as front load dumpsters. The support structure for such dumpsters, also referred to herein as containers, differs for respective types of apparatus as well as the size of the apparatus. Roll off dumpsters of the larger sizes utilize a roller shaped wheel at each of the four corners. Smaller roll off dumpsters often utilize roller shaped wheels at one end and a pair of ribs or runners near the corners of the end opposite the wheels.

A typical truck for placing a roll off dumpster carries the roll off dumpster with one longitudinal end of the dumpster extending beyond the body of the truck. The description of the elongated roll off dumpster herein will utilize the terms "inboard end" and "outboard end," respectively, to refer to the end of the dumpster nearest the cab of the truck and the end of the dumpster furthest from the cab of the truck when the dumpster is being carried by the truck. When the dumpster is loaded onto the truck the wheels of the dumpster at the outboard end of the dumpster are accessible to allow mounting of pads in accordance with aspects of the present disclosure. Smaller roll off dumpsters typically are supported on heavy duty steel wheels at the outboard end and rails or runners at the inboard end. The type of dumpster determines the embodiment of dumpster pad that will be used.

Figure 10:
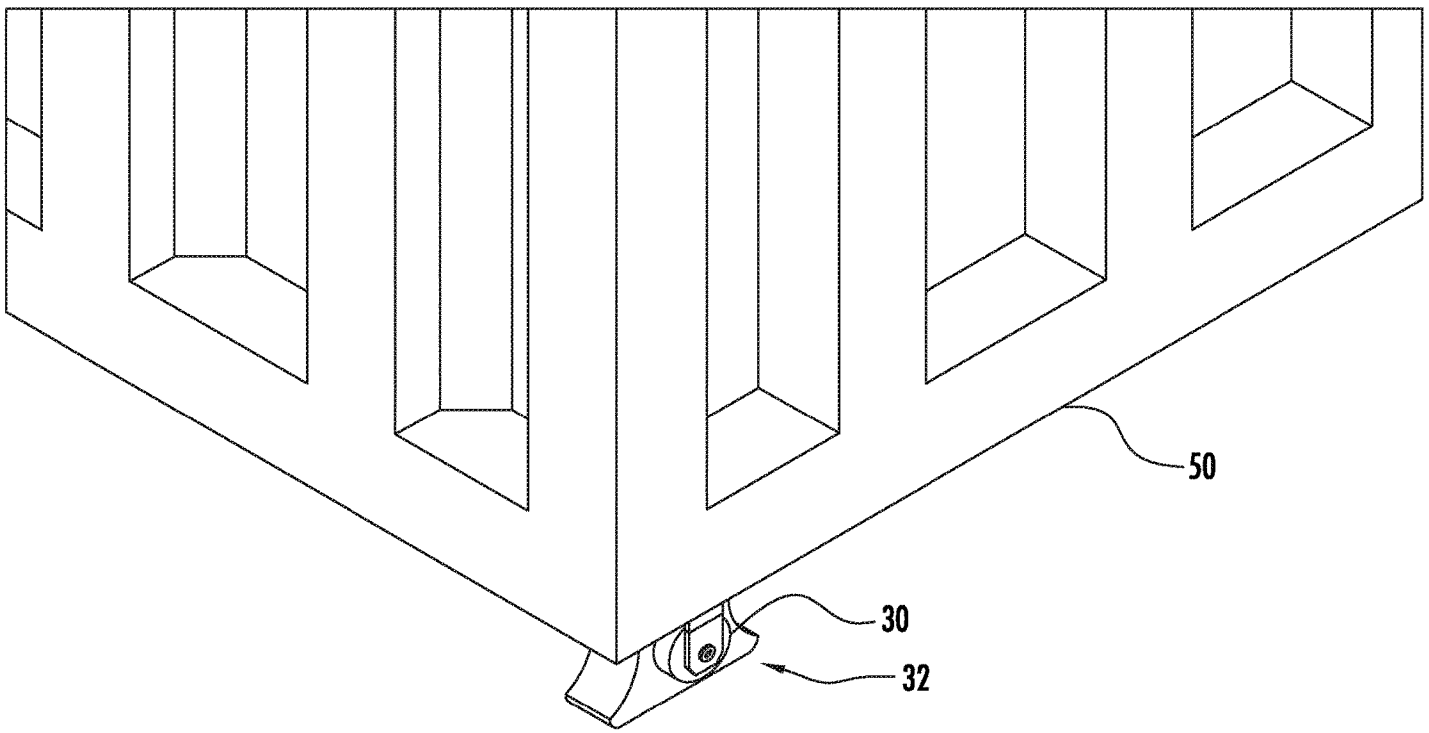
FIG. 10 is a partial perspective view showing one corner of a roll off dumpster and wheel to which is attached a pad of FIGS. 6-9 in accordance with aspects of the present disclosure.
Figure 11:
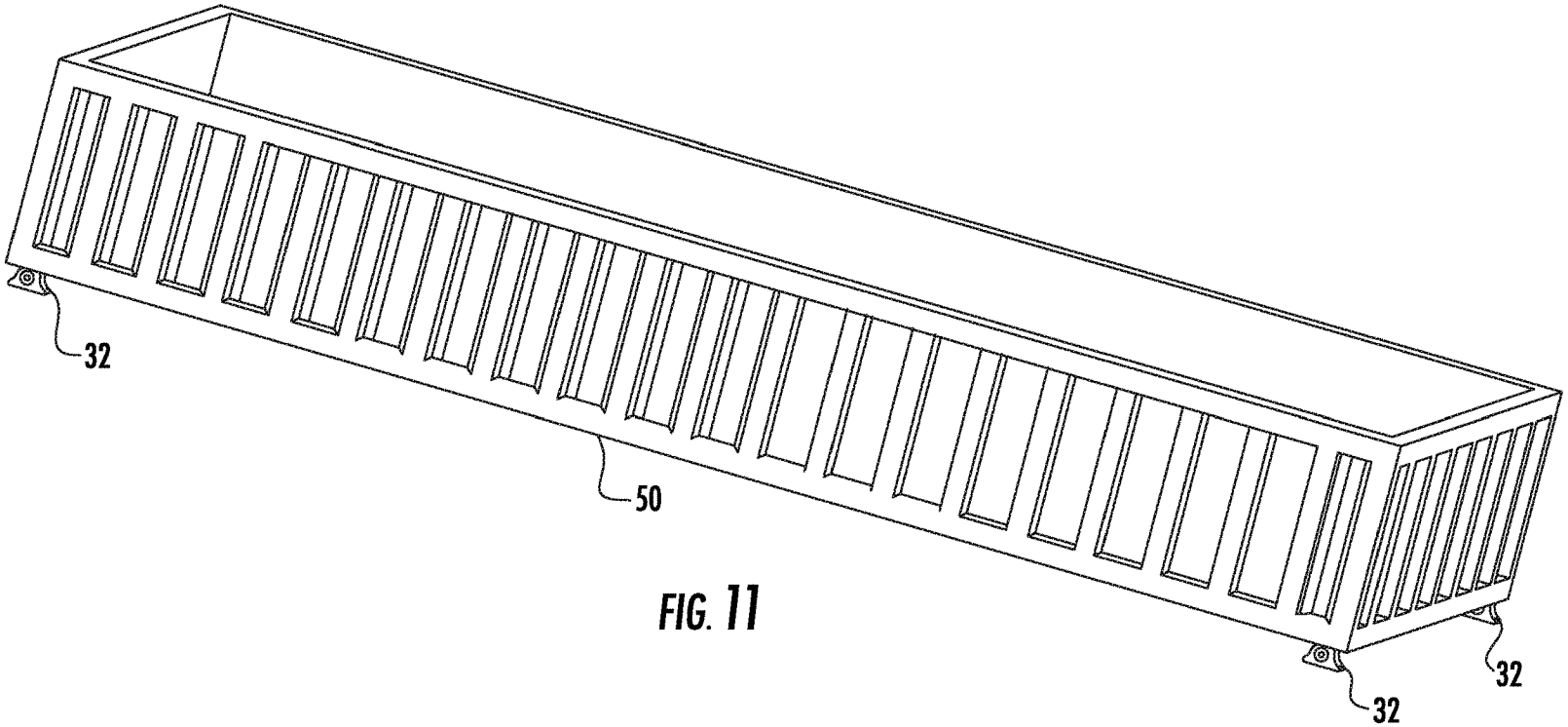
FIG. 11 is a perspective view of a roll off dumpster view similar FIG. 10 showing three roller wheels to which pads of FIGS. 6-9 are attached.
Figure 12:
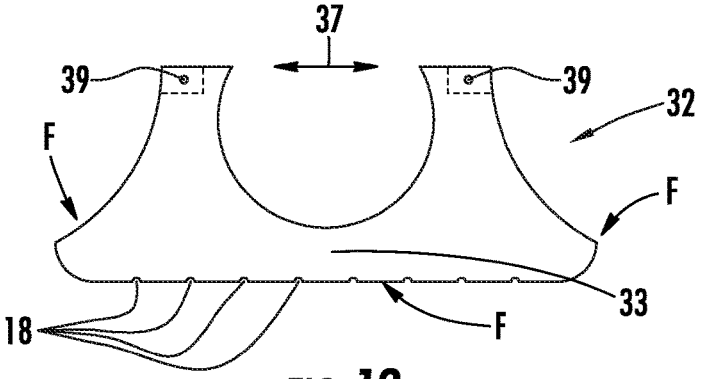
FIG. 12 is a side view of a dumpster pad according to aspects of the present disclosure.
Figure 13:
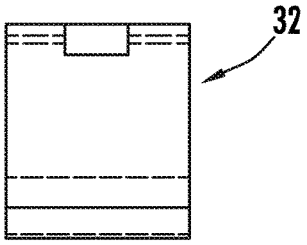
FIG. 13 is an end view of the pad of FIG. 12.
Figure 14:
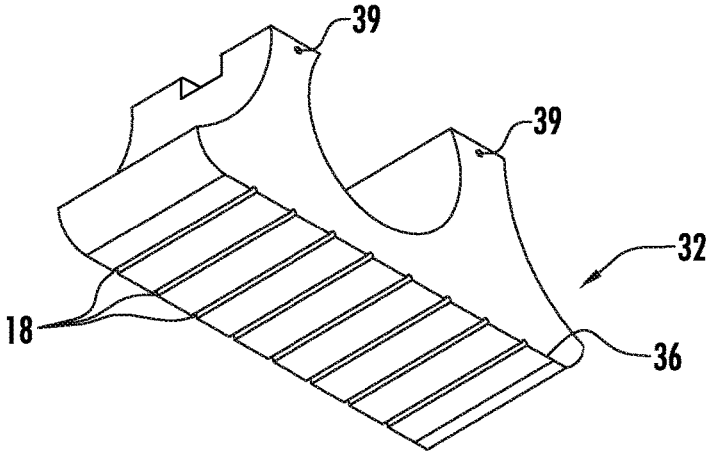
FIG. 14 is a bottom perspective view of the pad of FIGS. 11 and 12.
Figure 15:
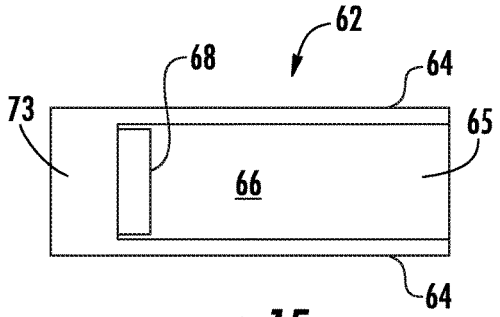
FIG. 15 is a top plan view of a third embodiment of a dumpster pad according to aspects of the present disclosure.
Figure 16:
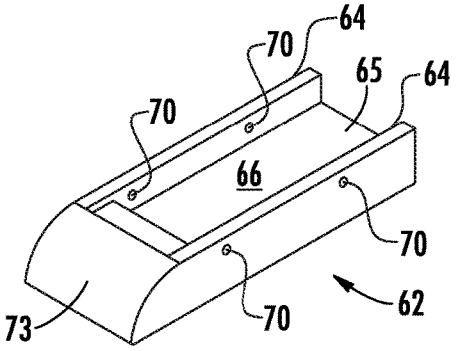
FIG. 16 is a left end perspective view of the pad of FIG. 15.
Figure 17:
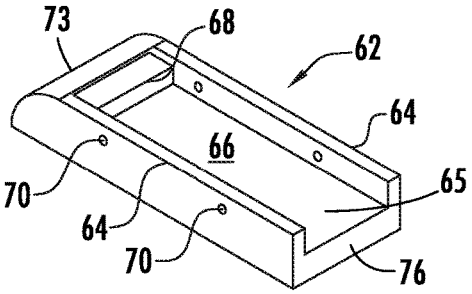
FIG. 17 is a right end perspective view of the pad of FIGS. 15 and 16.
Figure 18:
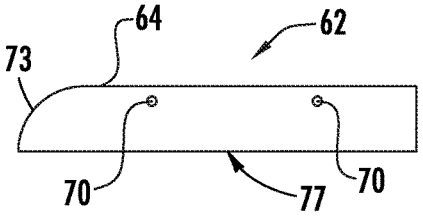
FIG. 18 is a side view of the pad of FIGS. 15-17.
Figure 19:
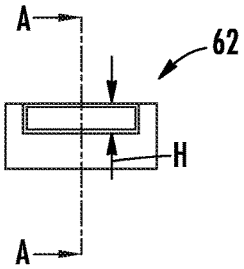
FIG. 19 is a right end view of the pad of FIGS. 15-18.
Figure 20:
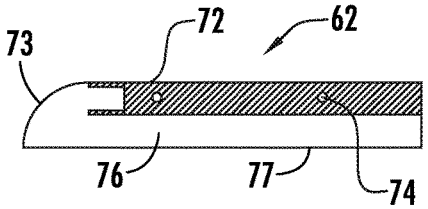
FIG. 20 is a sectional view of the pad of FIGS. 15-19, taken along line F-F in FIG. 19.
Figure 21:
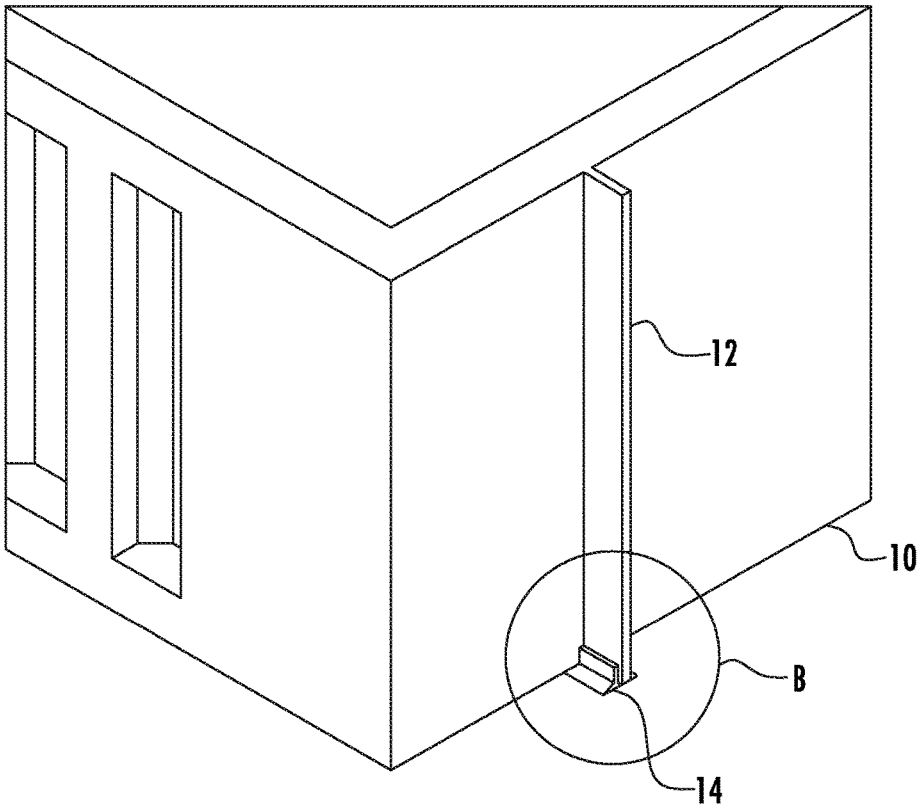
FIG. 21 is a partial perspective view of a roll off dumpster supported at one end by ribs (one shown) in functional conjunction with a pad illustrated in FIGS. 1-5.
Figure 22:
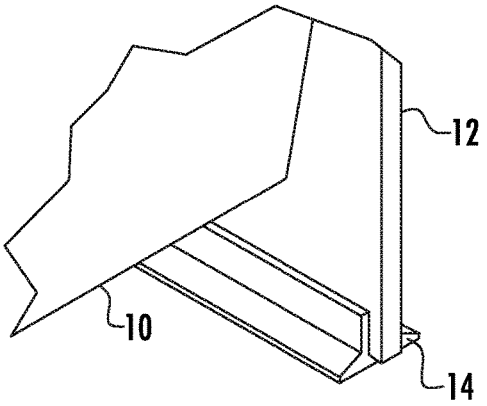
FIG. 22 is an enlarged partial view of the area B in FIG. 21, further illustrating the cooperation between the pad of FIGS. 1-5 with the rib of the dumpster.
Figure 23:
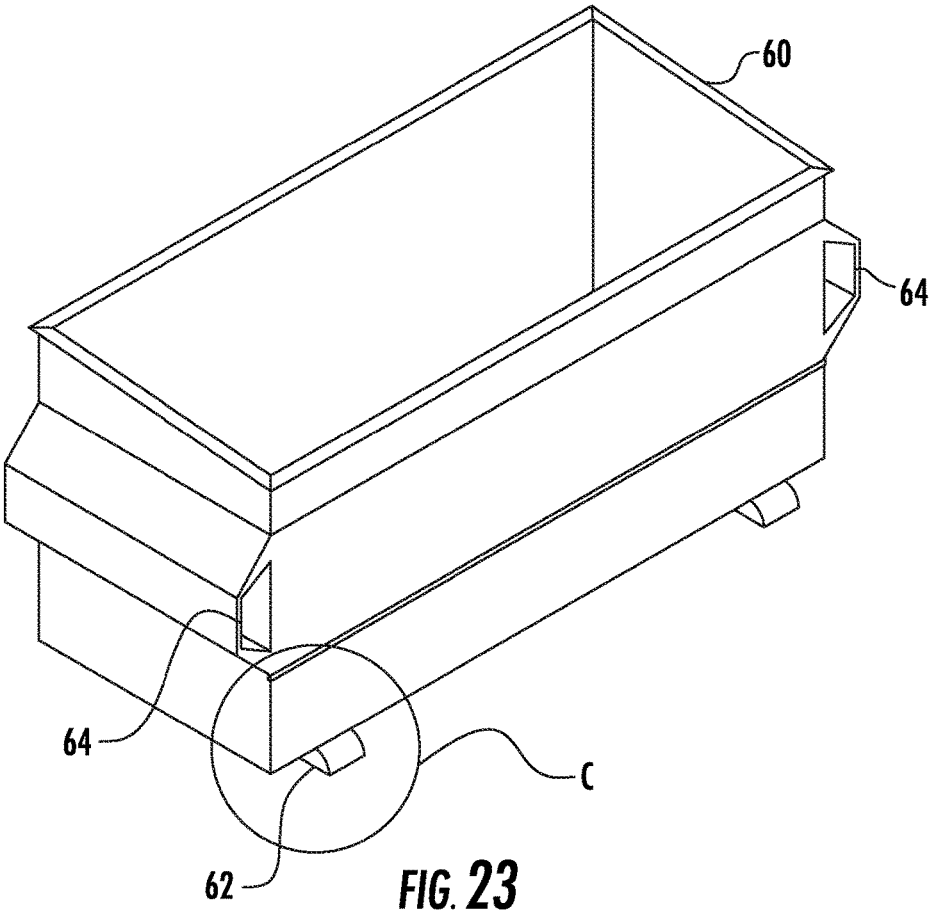
FIG. 23 is a perspective view of a front load dumpster in functional conjunction with dumpster pads illustrated in FIGS. 15-20.
Figure 24:
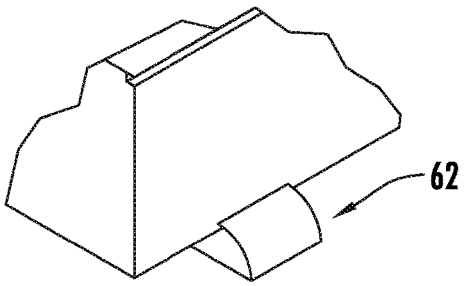
FIG. 24 is an enlarged partial perspective view of the area C of FIG. 23, showing in greater detail the pad of FIGS. 15-20 supporting the dumpster.

Three basic embodiments of a dumpster pad are shown. FIGS. 1-5 illustrate a pad 14 configured for use in conjunction with the ribs/rails of the inboard end of a smaller roll off dumpster 10, as shown in FIGS. 21 and 22. FIGS. 12-14 disclose a pad 32 configured for use with wheels 30 of a roll off dumpster 50 as shown in FIGS. 10 and 11. FIGS. 6-9 show the pad 32 of FIGS. 12-14 mounted to a dumpster wheel 30. FIGS. 15-20 illustrate a pad 62 configured for mounting to the box tube at the bottom of a front load dumpster 60, as shown in FIGS. 23 and 24.

FIG. 21 illustrates an axial extremity of a dumpster 10 having a rail 12 extending down the face of the dumpster as well as along the bottom surface thereof. The rail 12 supports the dumpster 10. A more detailed view is shown in FIG. 22. A first embodiment of the pad 14 in accordance with aspects of the disclosure is shown mounted to the rail in FIGS. 21 and 22. The pad 14 is further illustrated in FIGS. 1-5. Pad 14 includes a planar base 16 having transverse grooves 18 disposed at axially spaced intervals along the bottom surface of the pad 14. The grooves 18 provide a pathway for water or other liquids that may flow at the job site, and to improve the grip of the pad 14 on a paved surface.

Figure 1:
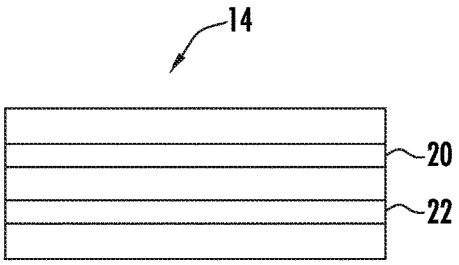
FIG. 1 is a top view of a first embodiment of a dumpster pad configured to mount on a rail disposed at one end of a roll off dumpster.
Figure 2:
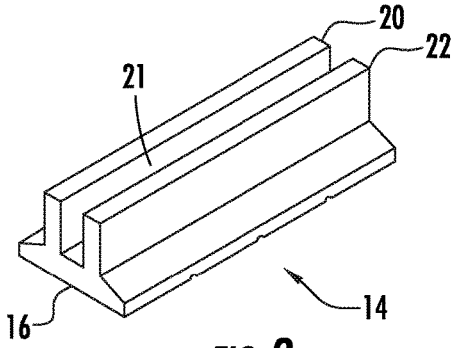
FIG. 2 is a perspective view of the pad illustrated in FIG. 1.
Figure 3:
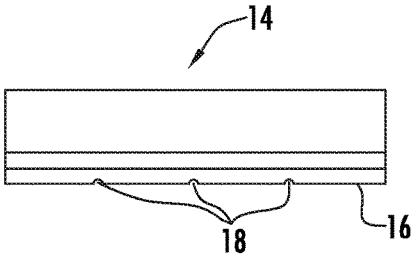
FIG. 3 is a side view of the pad illustrated in FIG. 1.
Figure 4:
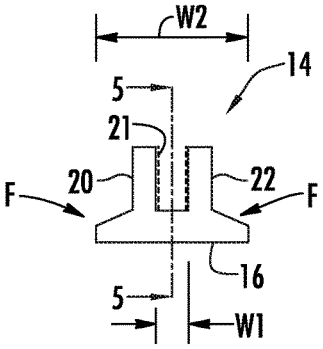
FIG. 4 is an end view of the pad illustrated in FIG. 1.
Figure 5:
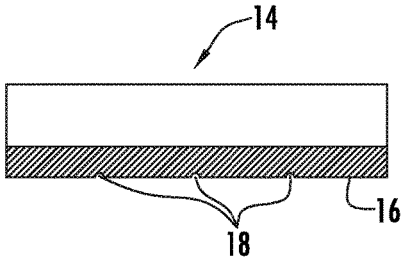
FIG. 5 is a sectional view of the pad of FIGS. 1-4, taken along the line 5-5 of FIG. 4.
Figure 6:
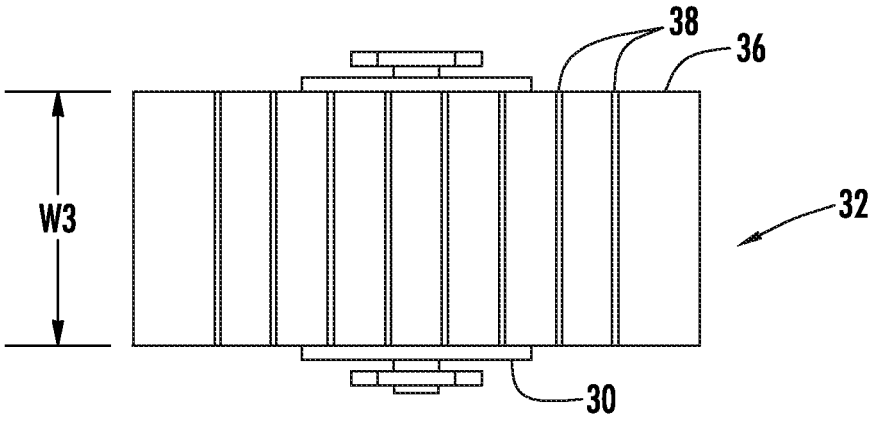
FIG. 6 is a bottom view of a second embodiment of a pad in accordance with aspects of the disclosure installed on the wheel of a roll off dumpster.

Upstanding members 20, 22 are disposed in parallel spaced relationship to define a channel 21. The spacing between the planar members 20, 22 defines the width W1 of the channel 21 determined by the thickness of the rib 12. Preferably the width of the channel 21 between the planar members 20, 22 provides a snug fit with the rib 12. In the illustrated first embodiment as best seen in FIGS. 2 and 4, the base 16 has a width W2 at least three times the width of the channel 21, and preferably 3 to 5 times the width W1 of the channel 21. The thickness T1 of the base 16 tapers from a maximum thickness beneath the channel 21 toward the edges of the base 16. Force F on the base 16 may be used to open the channel 21 during installation of the pad 14 over the rib/rail 12. The channel 21 may be narrower at its open end than at the base, to promote frictional engagement with the rib/rail 12.

A second embodiment of the pad 32 in accordance with aspects of the disclosure is particularly adapted for cooperation with roller shaped wheels 30. The term roller-shaped is intended to convey that the width of the wheels 30 is commonly greater than the diameter, with the result that each wheel resembles a roller. The pads 32 are illustrated in FIGS. 12-14 by itself, in FIGS. 6-9 mounted to a wheel 30 and in FIGS. 10 and 11 mounted to wheels 30 on a dumpster 50. Each pad 32 includes a cylindrical recess 34 dimensioned and configured for snug engagement with the outside circumference of a wheel 30. More particularly, a preferred embodiment of the pad 32 is dimensioned for snug engagement with more than 180° of the circumferential extent of the wheel 30. It will be understood that the engagement with greater than 180° of the circumferential extent of the wheel 30 prevents inadvertent release of the pad. Accordingly, it will be understood installation of the pad 32 on the roller shaped wheel 30 must be accomplished by axial movement of the pad 32 with respect to the wheel 30. The pad 32 has a generally planar base surface 36 that is also provided with transverse grooves 38 intended to provide a pathway for water or other liquids that may flow at the job site. The base surface 36 of the pad 32 has a width W3 that is typically at least as wide as the roller shaped wheel 30 to which it is attached, and has a length L at least twice the diameter D of the wheel 30.

The pads 32 may be constructed of durable, flexible material that is relatively soft. Such materials include rubber, recycled tire material, plastic and recycled plastic, but the pads 32 may be constructed of any suitable materials or combination of materials. One useful attribute of the material would be flexibility, which would permit the recess to be "opened" slightly during installation over a wheel 30. As shown in FIG. 12, force F at the ends of the pad 32 will bend the base at 33, opening the mouth of the pad at 37 slightly, allowing the wheel to easily enter the cylindrical recess 34. When force F is released, the flexible material returns to its original shape and grips the outside circumference of the wheel 30 as shown in FIGS. 7 and 8.

Figure 7:
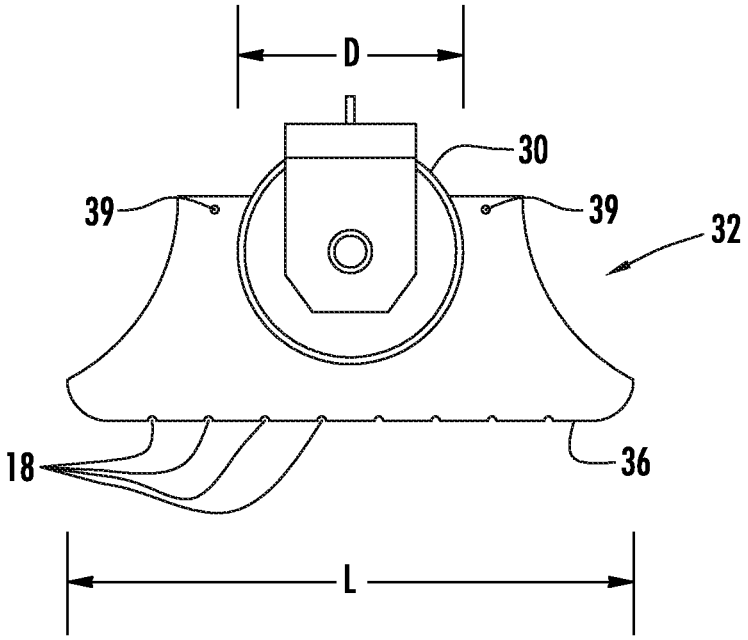
FIG. 7 is a side view of the pad of FIG. 6 installed on the wheel of a roll off dumpster.
Figure 8:
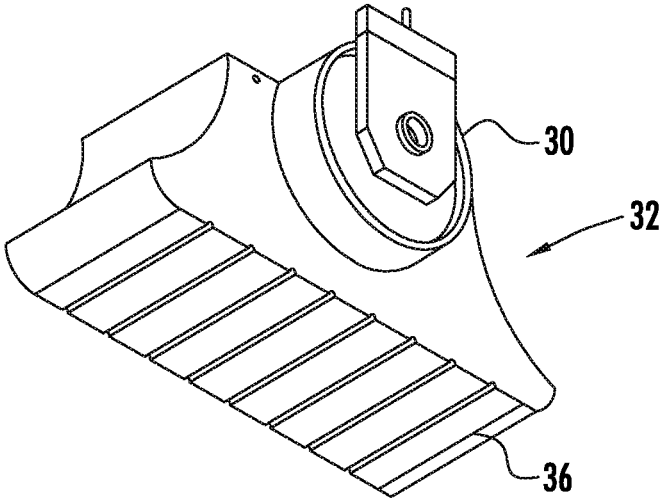
FIG. 8 is a perspective view of the pad and wheel of FIG. 7.

The outer extremities of the pad 32, as best seen in FIG. 7 are rounded to minimize the possibility of damage to the paved surface on which the dumpster is installed. Some embodiments may include holes 39 disposed near the top as shown in FIG. 7 to facilitate lashing the pad 32 to a wheel 30. The holes 39 may be reinforced so that wires or hardware used to secure the pad 32 to the wheel 30 will not pull through the material of the pad 32. Reinforcements include metal or plastic molded into or lining the holes 39. FIGS. 10 and 11 illustrate a dumpster 50 on which pads 32 are installed on roller shaped wheels 30. The same material attributes and manipulation can aid in installing the first embodiment of pad 14 onto the rib 12 of dumpster 10. See FIGS. 4 and 22.

Figure 9:
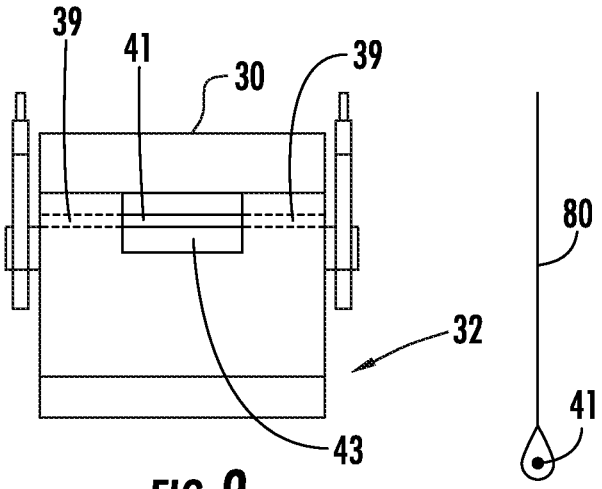
FIG. 9 is an end view of the pad and wheel of FIGS. 7, and 8.

A pin or bolt 41 may be inserted through holes 39 as shown in FIG. 9. This provides a bar spanning a notch 43 in the pad 32. The bar may be used as an anchor for a strap 60 with hook and loop material that can pass over the wheel 30, under a pin or bolt 41 on the opposite side of the pad 32 and engaged to itself to secure the pad 32 to the wheel 30. It is not intended that the pad 32 remain secured to the wheel 30 when the dumpster is in transit, but the strap 80 may be used to secure the pad 32 to the wheel while the dumpster is being dropped off. The strap 80 may be used to secure the pad 32 to rails running along the sides of the dumpster, to keep the pads securely attached during transit and keep them handy when needed. This arrangement also keeps the pads out of the cab of the truck, where they may not be permitted according to regulations.

One important function of the pads 32 is to act as a "chock" for the wheel received in the pad 32, not permitting the wheel 30 to roll along the paved surface onto which the dumpster is being installed. The sequence of actions for using the disclosed pads 32 is as follows. The driver/operator of the truck carrying a roll off dumpster approaches the location where the dumpster is to be lowered from the truck, and stops the truck. As previously discussed, the outboard end of the dumpster has two wheels 30 that are projected beyond the end of the truck and therefore accessible to the driver. The driver flexes a pad 32 as shown in FIG. 12 and slides the pad 32 over the outside of the wheel 30 until the pad is centered on the width of the wheel, or at least until the entire cylindrical inside surface 34 of the pad is on the wheel 30. This is done for both wheels 30. The lowering process is begun by raising the hydraulically actuated bed and beginning to extend the cable or hook. The outboard wheels with pads attached touch the ground with the base 36 of the pads 32 contacting the paved surface first. The relatively soft material of the pad 32 forms a highly frictional engagement with the paved surface, while the cylindrical surface 34 prevents the wheel 30 from rolling. This situation results in a pivot point at the outboard wheels, with the weight of the dumpster tending to push the truck away from the pivot. Slowly releasing the cable or hook will allow the weight of the dumpster 10, 50 to effectively push the truck away from the dumpster in a controlled manner. Before the inboard end of the dumpster 10, 50 contacts the ground, the driver will need to install pads 14 or 32 to the inboard support of the dumpster, whether that is a rib/rail 12 or wheel 30. The disclosed dumpster pads 14, 32 prevent movement of the dumpster supports over the paved surface, thereby preventing scraping or other damage during installation or removal. The dumpster pads also expand the surface area on which the dumpster is supported, reducing localized pressure and the likelihood of damage. Finally, pads 32 prevent rolling movement of a dumpster with four wheels, reducing the likelihood of a dumpster rolling from its installed location.

FIGS. 15-20, 23-25 illustrate a pad 62 in accordance with a third embodiment according to aspects of the present disclosure. This embodiment has particular application to front load dumpsters 64 that are typically moved by two elongated forks that engage the side channels 42 of a dumpster 44 (see FIG. 23). The front load dumpster 60 typically is provided with much wider support surfaces on the bottom face thereof in the form of open ended box tube members 90 (see FIG. 25) that span the depth or width of the dumpster 60. The dumpster 60 in FIG. 23 has box tube support members extending from front to back (not shown) .Those skilled in the art will recognize the term "box tube" to refer to tubing having a rectangular cross-section, the open ends of which define a rectangular opening (See ref. no. 90, FIG. 25).

Figure 25:
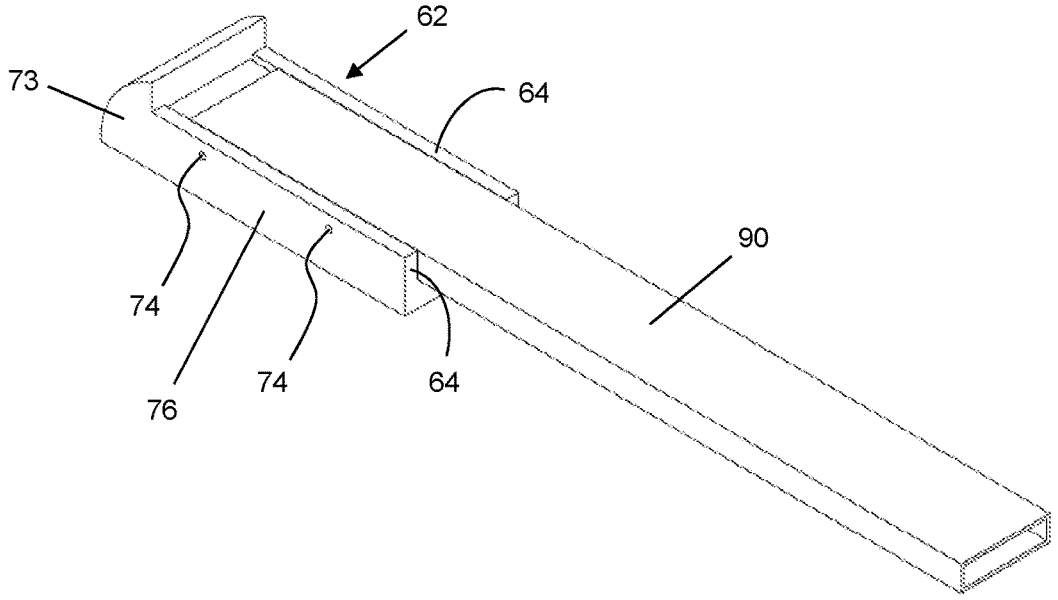
FIG. 25 is a perspective view of a dumpster pad in conjunction with a box tube according to aspects of the disclosure.

The pad 62 is configured to close the open end of a box tube and extend a base beneath the box tube 90, as shown in FIG. 25. The pad 62 includes upstanding parallel spaced apart members 64 that define a channel 65 for snug engagement with the outside surfaces of the box tube 90. The channel 65 has a bottom surface 66 that abuts and supports the bottom surface of the box tube 90. Thus, a trough shaped channel 65 is defined by the surface 66 and the upright members 64. The trough shaped region is open at the right axial extremity (as viewed in FIGS. 15-18 and 20). At one end of the channel 65, a rectangular plug 68 is disposed in the channel 65 and connected to a toe 73 that closes the end of the channel 64 behind the plug 68. The plug 68 is dimensioned to be received into the open end of the box tube 90, with the base 76 of the pad 62 extending beneath the bottom surface of the box tube 90. Accordingly, the pad 62 is installed by an axial movement wherein the plug 68 engages the box tube dumpster support and the toe of the pad closes the open end of the box tube as shown in FIG. 25. The plug 68 has a width that is compatible with the 3.5" standard width of most box tubes used to support front loading dumpsters. The plug 68 has a height H that is compatible with the smallest vertical dimension of standard box tube, about 1". The plug 68 is compatible with box tubes having a vertical dimension larger than about 1" and so will fit most dumpsters.

The base 76 may be configured to extend along a substantial length of the box tube, thereby providing a large surface area for the dumpster 60. The bottom surface 77 of the pad 62 may include grooves for enhanced grip or allowing water to flow past the pads 62. The pad 62 raises the dumpster by the height of the base 76, so the box tube no longer touches the ground. This can help prevent rusting of the box tube and reduce the need for repairs.

The upright members 64 of the pad may define holes 74 for hardware to secure the pad 62 on the box tube. The holes 74 may be reinforced with metallic inserts 72 running along either side of the channel 65. Fasteners such as self-tapping screws may be used to secure the pad 62 to the box member.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more."

What is claimed is:

1. A pad for cooperation with supports in the form of wheels on the bottom of a dumpster, each support having an outside circumferential surface including a ground contact area, wherein the pad comprises:

a body including a base and appendages for engaging the dumpster wheel, said appendages projecting upwardly from said base and having an arcuate inside surface defining a cylindrical recess complementary to the outside circumferential surface of the wheel, said cylindrical recess dimensioned to surround more than half of the circumferential surface of the wheel, wherein said base has a second ground contact area at least three times the contact area of the dumpster support body and said pad is configured to spread a ground contact force on said support over said second ground contact area.

2. The pad of claim 1, wherein said base includes a ground contact surface interrupted by a plurality of grooves.

3. The pad of claim 1, wherein said cylindrical recess has an inside diameter no greater than a diameter of the wheel, resulting in frictional engagement between the pad and the wheel.

4. The pad of claim 1, wherein the wheel has a width perpendicular to a diameter, and the base of said pad has a width equal to or greater than the width of said wheel.

5. The pad of claim 1, wherein said base has a length at least twice the diameter of the wheel.

6. The pad of claim 1, wherein said appendages include openings for a strap to extend between the appendages to fix the pad to the wheel when in use.

7. The pad of claim 1, where said pad is constructed of material having an elasticity greater the average metal.

8. The pad of claim 1, wherein said pad is constructed of flexible material and said appendages can be spread apart during installation of the pad to the support, with the pad gripping the support after installation.

9. The pad of claim 1, wherein the pad has a constant sectional shape and is manufactured at least in part by extrusion.

10. The pad of claim 1, wherein said pad is manufactured of rubber or plastic.

11. The pad of claim 1, wherein said pad is molded from rubber or plastic.

* * * * *